US005465424A

United States Patent [19]

Cudney et al.

[11] Patent Number: 5,465,424

[45] Date of Patent: Nov. 14, 1995

[54] BODY PROTECTOR

[75] Inventors: Douglas J. Cudney; Karen E. Breitbach, both of Orangeville, Canada

[73] Assignee: Tipperary Sport Products, Inc., Ontario, Canada

[21] Appl. No.: 124,185

[22] Filed: Sep. 21, 1993

[51] Int. Cl.[6] ..... A41D 13/00; A41D 1/04

[52] U.S. Cl. ..... 2/2; 2/25; 2/92; 2/267; 2/102

[58] Field of Search ..... 2/2, 2.5, 311, 44, 2/92, 312, 117, 323, 267, 268, 102, 919, 920, 60, 129, 130; 450/155

[56] References Cited

U.S. PATENT DOCUMENTS

| | | | |
|---|---|---|---|
| 1,623,993 | 4/1927 | Anderson | 2/102 X |
| 1,716,061 | 6/1929 | Janke | 2/102 X |
| 3,125,762 | 3/1964 | Glahe | 2/2 |
| 4,242,769 | 1/1981 | Rayfield et al. . | |
| 4,441,211 | 4/1984 | Donzis | 2/2 |
| 4,568,585 | 2/1986 | Kohn et al. . | |
| 4,602,384 | 7/1986 | Schneider | 2/2 |
| 4,608,717 | 9/1986 | Dunbavand | 2/2.5 |
| 4,625,335 | 12/1986 | Vinai . | |
| 4,739,522 | 4/1988 | Lassiter et al. . | |
| 4,764,238 | 8/1988 | Dastin et al. . | |
| 4,847,913 | 7/1989 | Chen | 2/2 |
| 4,884,295 | 12/1989 | Cox | 2/2 |
| 4,923,728 | 5/1990 | Snedeker | 2/2.5 X |
| 5,002,270 | 3/1991 | Shine | 2/102 X |
| 5,020,156 | 6/1991 | Neuhalfen | 2/2 |
| 5,059,467 | 10/1991 | Berkovitz | 2/2 X |
| 5,072,453 | 12/1991 | Widder | 2/2.5 |
| 5,136,724 | 8/1992 | Grilliot et al. . | |
| 5,274,851 | 1/1994 | Simpkins, Sr. et al. | 2/102 |

FOREIGN PATENT DOCUMENTS

| | | | |
|---|---|---|---|
| 8803765 | 6/1988 | European Pat. Off. | 2/267 |
| 9205717 | 4/1992 | European Pat. Off. | 2/2 |
| 7908416 | 11/1980 | France | 2/2 |
| 2124887 | 2/1984 | United Kingdom . | |
| 2225708 | 6/1990 | United Kingdom | 2/2 |
| 2234156 | 1/1991 | United Kingdom . | |

*Primary Examiner*—Paul C. Lewis
*Attorney, Agent, or Firm*—David H. Semmes

[57] ABSTRACT

Body protectors, particularly an articulated shock absorbing vest for use in the equestrian sports. The vest is characterized by its capability of absorbing traumatic impact and crush, while not interferring with movement of the equestrian rider's torso and arms. The vest includes a back panel and two adjoining side panels conformed to fit the human torso. Each panel includes a plurality of shock absorbing cellular foam ribs independently and movably supported in skeletal array. A protective spinal sheath is supported upon the back panel.

12 Claims, 4 Drawing Sheets

BODY PROTECTOR

BACKGROUND OF THE INVENTION:

1. Field of the Invention

Body protectors, particularly an articulated shock absorbing vest for use in the equestrian sports. The vest is characterized by its ability to absorb impact without interfering with movement of the equestrian rider's arms and torso.

2. Description of the Prior Art

CHEN U.S. Pat. No. 4,847,913
COX U.S. Pat. No. 4,884,295
SNEDEKER U.S. Pat. No. 4,923,728
NEUHALFEN U.S. Pat. No. 5,020,156
VINAI U.S. Pat. No. 4,625,335
WIDDER U.S. Pat. No. 5,072,453
GRILLOT et al. U.S. Pat. No. 5,136,724
RAYFIELD et al. U.S. Pat. No. 4,242,769
KOHN U.S. Pat. No. 4,568, 585
SCHNEIDER U.S. Pat. No. 4,602,384
LASSITER et al. U.S. Pat. No. 4,739,522
DASTIN et al. U.S. Pat. No. 4,764,238
BERKOVITZ U.S. Pat. No. 5,059,467

SUMMARY OF THE INVENTION

According to the present invention there is provided an articulated shock absorbing protective vest of the type having neck and arm apertures. The vest includes a back panel and two adjoining side panels conformed to fit the human torso. The side panels are adjustably and releasably secured to the sides of the back panel and releasably secured to each other along a vertical axis of the human sternum. A plurality of shock absorbing cellular foam ribs are independently and movably supported in skeletal array within the panels and a protective spinal sheath is supported upon the back panel so as to extend from the neck aperture to the lumbar portion of the panel. The ability of the vest to withstand shock or impact as a result of sharp object puncture, blunt object damage or heavy object crush has been conclusively established in British Equestrian Trade Association (BETA) tests.

DESCRIPTION OF THE PREFERRED EMBODIMENTS

Figure 1:
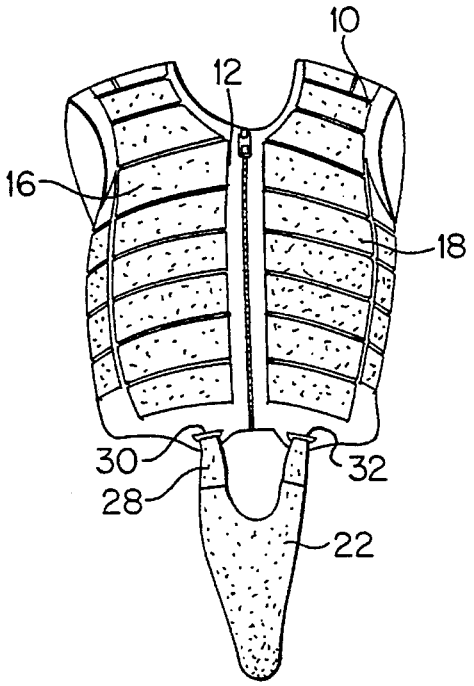
FIG. 1 is a front elevation of the body protector fitted upon the human torso and including an athletic support harness for tensioning the vest in its proper vertical position.

In FIG. 1, there is illustrated a Body protector in the form of vest 10 formed by a flexible weave fabric and comprising individual side panels 16, 18 removably joined by a zipper 12 along the vertical axis of the sternum. Vest 10 may be positioned and vertically tensioned by athletic supporter harness 22 extending from the back panel lower edge through the rider's legs for securement to the lower edge front of the side panels 16, 18 by means of "Velcro" hook and loop type or similar type assembly 28.

Figure 2:
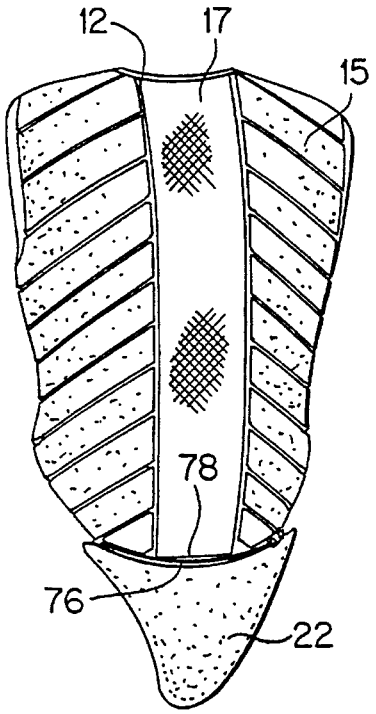
FIG. 2 is a rear elevation thereof.

In FIG. 2, back panel 14 is illustrated as including protective spinal sheath 17, extending from the neck portion of back panel 14 to lower edge 78 of the lumbar portion. Zipper 76 may be used to fasten harness 22 to lower edge 78. Loops 30, 32 at the lower front edge of side panels 16, 18 are used for securing support straps 26, 28.

Figure 3:
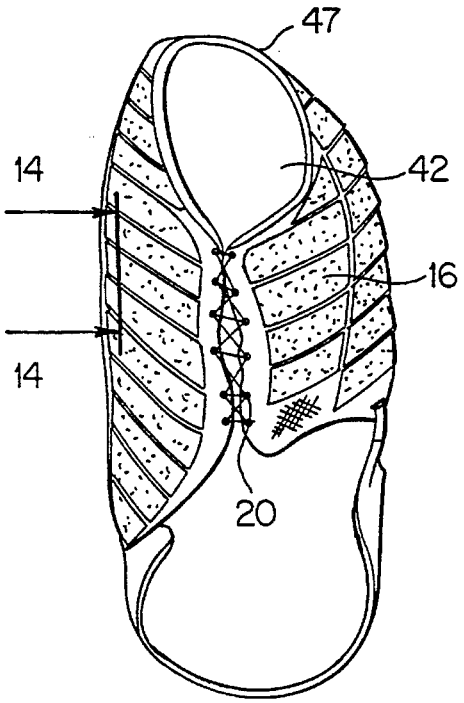
FIG. 3 is a right side elevation.
Figure 4:
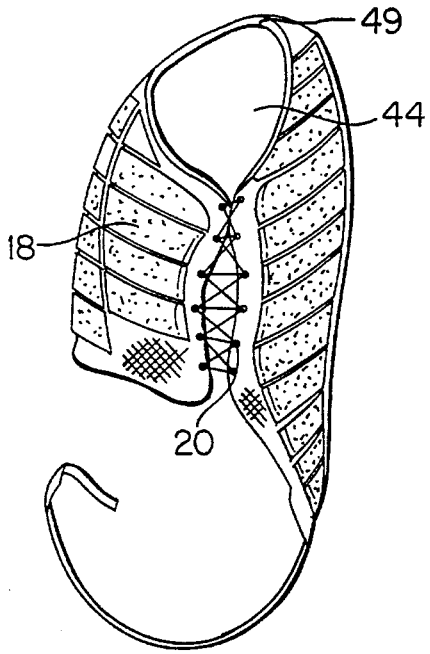
FIG. 4 is a left side elevation.

In FIGS. 3 and 4, individual arm apertures 42 and 44 are illustrated as formed by edges 47, 49 of the side panels 16, 18 and back panel 14. Individual shock absorbing cellular foam ribs 15 are independently positioned by stitched rectangular pockets both within back panel 14 and side panels 16, 18 such that ribs 15 are approximately ¼ inch apart and aligned in skeletal array with the ribs being parallel to the human rib cage. Lacing 20 may be employed to adjust the edges of the side panels with respect to the adjoining edges of the back panel 14, so as to achieve proper fit.

Figure 7:
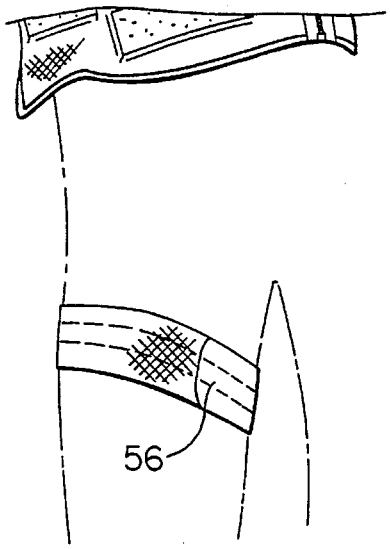
FIG. 7 is an enlarged front elevation, showing leg strap harness straps secured around the thigh of the equestrian.
Figure 8:
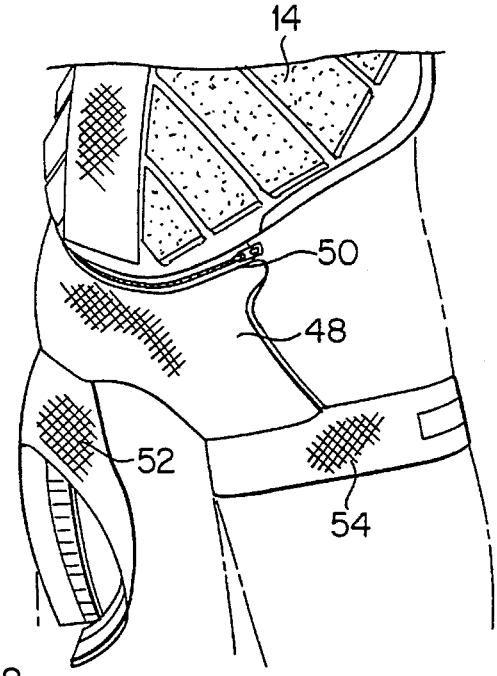
FIG. 8 is a fragmentary rear elevation showing the leg strap harness removably attached by zipper to the lower edge of the back panel.

In FIGS. 7 and 8, a modified harness 48 in the form of leg wraps 52, 54 may be employed such that the ends of the wrap may be releasably secured by Velcro means 56. A zipper 50 may be employed to attach harness 48 to the lower edge of back panel 14.

Figure 5:
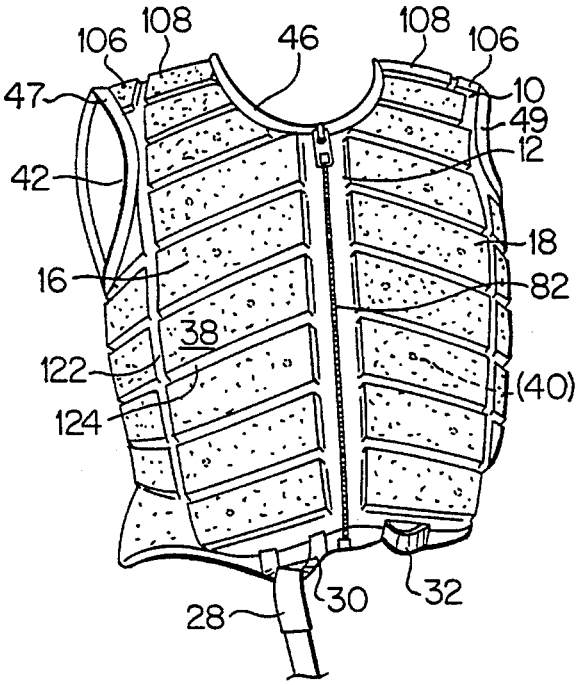
FIG. 5 is an enlarged front elevation, illustrating zipper fastening of the side panels along the vertical axis of the sternum.

In FIG. 5, front panel 16 is illustrated as comprised of a web or shell made of mesh-like material, such as "nylon" as manufactured by E. I. dupont Nemors or "Spectra", such as manufactured by Allied Signal, such that the vest "breathes". A series of individual breathing apertures 40 are employed for the same purpose in each rib 18.

Figure 13:
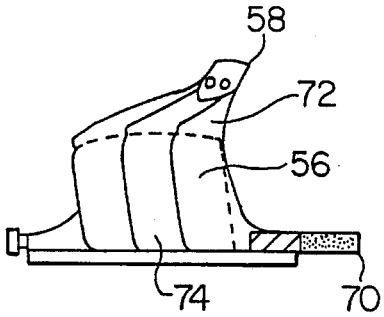
FIG. 13 is a front elevation of a shoulder pad prior to attachment to the shoulder portion of the back panel.

As illustrated in FIG. 5, arm apertures 42, 44 may include an open foam cell padded edge 47, 49 for rider comfort. A similar open foam cell edge 46 is defined at the perimeter of the neck aperture. As illustrated in FIG. 4, back panel 14 shoulder portion may include one or more articulated ribs 106, 108 as well as conventional shoulder loops for supporting the shoulder pad assembly 74 as illustrated in FIG. 13. Shoulder pad loop 58 extends through the respective loops 34, 36 such that horizontal rib 72 and vertical rib 56 are supported above the shoulder area. The lower portion of shoulder pad assembly 74 may encircle the rider's arm for securement by "Velcro" means 70.

Figure 9:
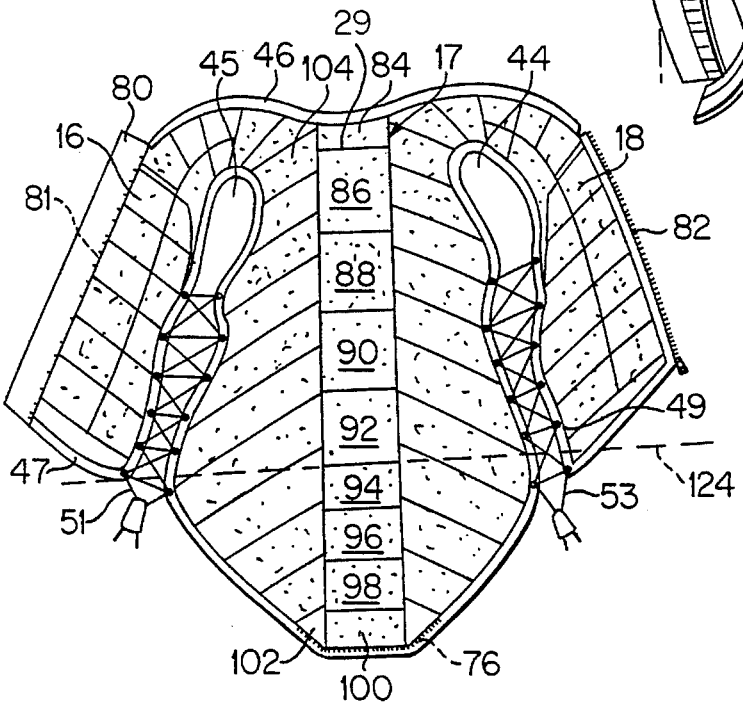
FIG. 9 is an enlarged front elevation of the inside of the opened vest, showing shock-absorbing cellular foam ribs 86 et al. independently positioned in the spinal sheath 17 by means of stitching 29.

In FIG. 9 there is illustrated inside 19 of back panel 14, as embodying diagonally supported ribs 104. The individual side panels embody similar closed cell foam pads with complementary zipper elements 81, 82 for securement to each other along the vertical axis of the sternum. Lace elements 51, 53 may be entwined in suitable grommets so as to adjustably secure the side panels 16, 18 to back panel 19. As will be noted, cellular foam pads may be especially tailored as at 102, 104 to fit the complex angles of the garment.

Figure 6:
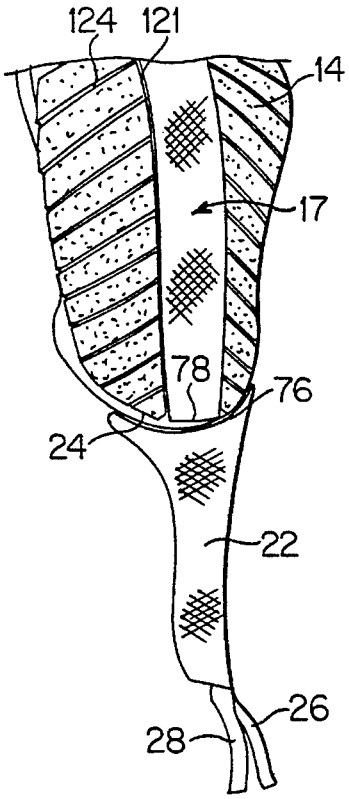
FIG. 6 is a rear elevation showing the back panel with the athletic support harness attached by zipper at the lower edge of the back panel.
Figure 14:
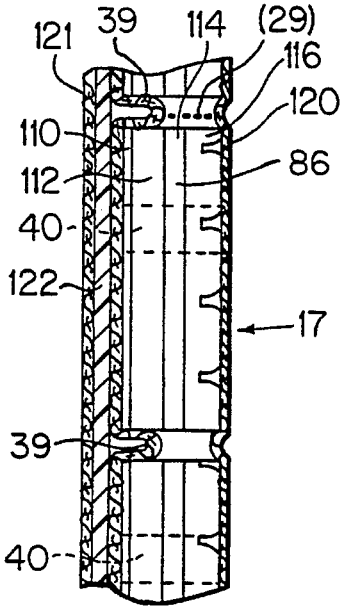
FIG. 14 is a fragmentary vertical section through protective spinal sheath 17, showing the vest webbing folded as at 39 and stitched as at 29 between the cellular foam ribs.

As illustrated in FIGS. 6 and 9, spinal sheath 17 is comprised of outer ballistic material tape such as "Spectra Shield" as manufactured by Allied Signal and embodying rows of "Spectra" fiber bonded at right angles with a flexible resin to form an ultra lightweight composite, so as to form a pocket for support of the individual cellular foam ribs. Between inner panel 120 of flexible fabric and outer ballistic material tape 122 and flexible web 121 are independently positioned a plurality of horizontally disposed cellular foam ribs 84, 86, 88, 90, 92, 94, 96, 98 and 100. At illustrated in FIG. 14 the flexible fabric is folded as at 39 between the cellular ribs and held in place by stitching 29. The flexible fabric 39 and the stitching 29 act as horizontal axes about which the cellular foam ribs pivot. As will be apparent, the ribs 94, 96, 98 and 100 are positioned below waistline 124 and have a lesser height so as to afford increased mobility in the lumbar portion of the vest. In any case, as will be apparent spinal sheath 17 is a laminate formed by ballistic material on the outside and flexible weave fabric on the inside with shock absorbing cellular foam pads, independently positioned therebetween.

Figure 10:
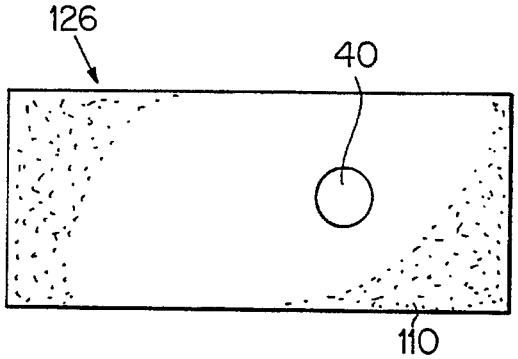
FIG. 10 is a top plan of the individual cellular foam rib.
Figure 11:
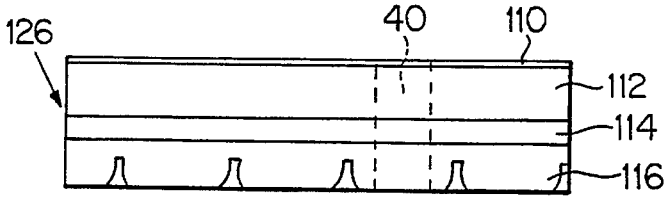
FIG. 11 is a side elevation of the cellular foam rib.
Figure 12:
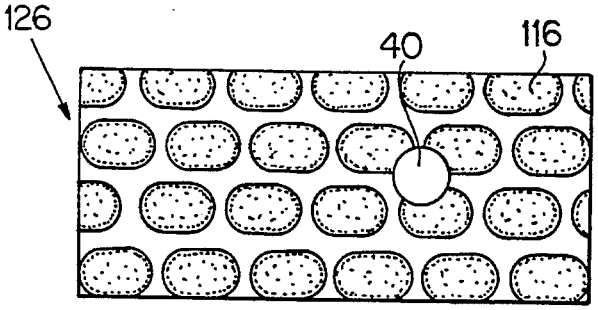
FIG. 12 is a bottom plan of the cellular foam rib, showing its waffled exterior surface.

As illustrated in FIGS. 10–12, the individual cellular foam pads are constructed of cross-linked limited high density polyurethane foam layers laminated together. The individual pads may comprise an interior grid or waffling 116 of number two denier, a closed cell foam 114 of number 11 denier and open cell foam core 112 of number 9 denier and an outer layer of closed cell foam 110 of number 2 denier. These layers are laminated together with individual transverse holes 40 being provided for ventilation of body heat.

Similarly, the backing piece 80 illustrated in FIG. 9 for vest zipper 82 may be of a closed cell foam number 2 denier.

The skeletal or diagonal array of the cellular foam cells enhances unrestricted body movement, while laterally defusing impact or shock. The athletic or flexible mesh of the exterior web or shell such as "nylon" or "Spectra" enables "breathing" of the entire garment which may weigh less than two pounds.

Manifestly, variations in weaving of the exterior shell, manufacture of the closed cell foam pads and their array within the garment may be employed without departing from the spirit of the invention.

We claim:

1. An articulated shock absorbing body protector in the form of a vest conformed to fit the human torso, having an upper shoulder portion, a waist portion and a lower lumbar portion, as well as a neck aperture and arm apertures in said shoulder portion, comprising:

a. a back panel having upper, lower and side edges conformed to fit the human torso;

b. two side panels, each panel having upper, lower, front and back edges and conformed to fit the human torso, each side panel being joined at said upper edge to said back panel at said shoulder portion and extending over the side and front of the torso, said side panels being releasably joined to each other at said front edge at a vertical axis extending from the neck aperture to said lower edge of each side panel;

c. a plurality of shock absorbing cellular foam ribs independently and movably supported in skeletal array within said back panel and side panels, said ribs in said back and side panels being aligned with each other and being parallel to the human rib cage; and d. a protective spinal sheath supported upon said back panel and extending from said neck aperture portion to said lumbar portion, said spinal sheath including an outer lightweight shield of flexible ballistic material tape and an inner core of shock absorbing horizontally disposed cellular foam ribs independently and movably supported and pivotable about horizontal axes adjacent said shield of flexible ballistic material tape.

2. An articulated shock absorbing protective vest as in claim 1, said side panels being releasably and adjustably secured to said back panel along an axis extending from each arm aperture to said lumbar portion of said back panel along said side edge.

3. An articulated shock absorbing protective vest as in claim 2, said cellular foam ribs being comprised of a sandwich of foamed material including an outer layer of dense closed cell foam, a middle layer of open cell foam and an inner layer of closed cell foam.

4. An articulated shock absorbing protective vest as in claim 3, said inner layer of closed cell foam having an exterior waffled surface enabling air circulation.

5. An articulated shock absorbing protective vest as in claim 4, said back and side panels being comprised of an open weave shell of flexible material enabling breathing through the vest.

6. An articulated shock absorbing protective vest as in claim 5, said side panels being releasably joined along the vertical axis by means of a front fastener having a protective layer of flexible plastic fiber extending under the front fastener from the upper edge to the lower edge of each side panel.

7. An articulated shock absorbing protective vest as in claim 6, including a leg support garment extending from said lower edge of the back panel lumbar portion.

8. An articulated shock absorbing protective vest as in claim 6, including an athletic type support extending from the lower edge of the back panel lumbar portion between the wearer's legs for adjustable fastening to the lower front edge of each said side panel.

9. An articulated shock absorbing protective vest as in claim 6, said back panel shoulder portion including left and right shoulder loops in combination with shoulder pads adjustably positioned thereon.

10. An articulated shock absorbing protective vest as in claim 2, including a padded reinforcing edge secured to the neck portion defined in said back panel and said side panels.

11. An articulated shock absorbing protective vest as in claim 5, said ribs being of rectangular configuration and supported approximately ¼ inch apart.

12. An articulated shock absorbing protective vest as in claim 5, wherein said side panels are articulated on a vertical axis defined by adjacent rows of diagonally aligned cellular foam ribs.

* * * * *